US008663406B1

(12) United States Patent
Aubert et al.

(10) Patent No.: US 8,663,406 B1
(45) Date of Patent: Mar. 4, 2014

(54) MELT CAST INSENSITIVE EUTECTIC EXPLOSIVE

(75) Inventors: Stephen A. Aubert, Abingdon, MD (US); Brian D. Roos, Elkton, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 2303 days.

(21) Appl. No.: 11/540,573

(22) Filed: Oct. 2, 2006

(51) Int. Cl.
*C06B 31/54* (2006.01)

(52) U.S. Cl.
USPC ..... 149/88; 149/92

(58) Field of Classification Search
USPC ..... 149/88, 92
See application file for complete search history.

(56) References Cited

U.S. PATENT DOCUMENTS 4,705,582 A 11/1987 Aubert
4,948,438 A 8/1990 Patrick et al.
5,997,668 A 12/1999 Aubert

*Primary Examiner* — Carol M Koslow
(74) *Attorney, Agent, or Firm* — Richard A. Morgan; Christos S. Kyriakou

(57) ABSTRACT

A insensitive explosive comprises:

34.9 wt % diethylenetriamine trinitrate (DETN), 33.4 wt % ethylenediamine dinitrate (EDD), 25.4 wt % methyl-guanidine (MeNQ), and 6.3 wt % guanidine (NQ).

This quaternary eutectic is used in combination with a sensitive explosive. A low melting temperature facilitates melt casting to fill 155 mm artillery shells.

20 Claims, 2 Drawing Sheets

MELT CAST INSENSITIVE EUTECTIC EXPLOSIVE

STATEMENT OF GOVERNMENT INTEREST

The invention described herein may be manufactured and used by or for the Government of the United States of America for governmental purposes without the payment of a royalty.

BACKGROUND OF THE INVENTION

1. Field of the Invention

The invention relates to explosive materials. More particularly the invention relates to insensitive explosives. Most particularly, the invention relates to melt cast mixtures of insensitive explosive materials and sensitive explosive materials.

2. Discussion of the Related Art

Explosive materials are classified under a U.S. Department of Transportation standard as hazardous materials. Explosive materials are be sub classified in one of the defined sub categories from Mass Explosion Hazard (1.1) at one end of the scale to Explosive Article, Extremely Insensitive (1.6) at the other end of the scale. The utility of an explosive is inversely related to its propensity to detonate. Utility in this sense means detonation insensitivity during handling, transportation, and storage.

Military munitions with a lower hazard classified explosives have the advantages of reduced vulnerability to sympathetic detonation, detonation during transportation and handling and detonation with extended storage and temperature cycling.

Research at Livermore National Laboratory found that formulations of nitroguanidine and triaminotrinitrobenzene (TATB) were very resistant to accidental detonation. Extensive testing of PBX-9502 (95% TATB, 5% polymer binder) resulted in a new hazard classification for Insensitive High Explosive (IHE). The discovery of insensitive high explosives significantly reduced the requirements and therefore the cost of handling and storing these materials.

The Department of Defense Explosive Safety Board established hazard classification Class 1.5 for Insensitive Explosives to identify the significant insensitivity to detonation of triaminotrinitrobenzene (TATB). New explosives have been found that have extremely low probability of round-to-round, en mass reaction of projectiles containing the explosives. Explosives in this category are classified as Extremely Insensitive Detonating Substances (EIDS) in Class 1.6. These explosives are distinguished from blasting agents.

Use of reduced hazard classification explosives in conventional projectiles provides substantial advantages in operational readiness, sustainability, and survivability due to their reduced quantity distance (QD) storage and handling requirement restrictions and vulnerability. The use of detonation insensitive explosives also reduces the exposure of the public to potential hazard during transportation of munitions over public roadways.

Ammonium nitrate has been used in low melting point explosive compositions. The physical properties of ammonium nitrate present a number of disadvantages in explosives. It is hydroscopic which presents a maintenance problem over the storage life. It also requires a phase stabilizer which adds parasitic weight to any formulation and dilutes explosive performance. Other nitrate salts have also been used as explosives, but they have an excess of fuel or some other disadvantage.

There is a need in the art for an explosive composition with reduced sensitivity to impact, friction, and shock. Sensitivity results in vulnerability of rounds, projectiles, bombs and warheads to cook-off, premature reaction and round-to-round propagation (mass, detonation), and reactivity to the impact of bullets, high velocity fragments, shape charge jets, electrostatic discharge and heat.

SUMMARY OF THE INVENTION

The invention is an insensitive explosive composition. The composition comprises diethylenetriamine trinitrate (DETN) and methyl-nitroguanidine (MeNQ), in a molar ratio of 0.55:1 to 1.35:1. This composition includes the eutectic composition. The composition is characterized in the absence of ammonium nitrate.

The invention is also an insensitive explosive composition comprising a nitrate salt and a nitroguanidine in a molar ratio of 0.55:1 to 1.35:1. The nitrate salt is selected from the group consisting of: diethylenetriamine trinitrate (DETN), ethylenediamine dinitrate (EDD), and mixtures thereof. The nitroguanidine is selected from the group consisting of methyl-nitroguanidine (MeNQ), nitroguanidine (NQ), and mixtures thereof.

The compositions are useful as a melt cast explosive for artillery shells and the like.

DETAILED DESCRIPTION OF THE PREFERRED EMBODIMENTS

A eutectic mixture is a composition of two or more chemical compounds that melt completely at a temperature minimum to form a single, homogeneous liquid. On cooling, the homogeneous liquid solidifies to form a single solid comprising two intimately dispersed solid phases. The eutectic melting temperature is the lowest temperature at which a mixture of the chemical compounds melts. The eutectic melting temperature is anomalous in that it is usually much lower than the melting temperatures of mixtures of slightly different compositions. The melting temperature and the composition are unique and unpredictable physical properties of the eutectic.

It has been found that some oxidizers and fuels form eutectic mixtures. Accordingly, the formation of eutectic mixtures has been used to provide the intimate mixing of oxidizer and fuel in explosive compositions. An additional benefit is the reduction in melting temperature. Melting a mixture in a casing is a convenient method of filling projectiles. This method is known as melt casting.

Melt casting includes heating an explosive composition to a temperature above the melting point, optionally admixing any solid powders to the melt, pouring the admixture into a cavity, and allowing the admixture to cool and solidify.

Ethylenediamine dinitrate (EDDN) and higher analog salts form a double salt with ammonium nitrate (AN). Ethylenediamine dinitrate (EDDN) and higher analogs also for eutectics with ammonium nitrate (AN). In particular, the double salt of diethylenetriamine trinitrate (DETN) and ammonium nitrate (AN) forms a eutectic.

Nitroguanidine (NQ) and methyl-nitroguanidine (MeNQ) form double salts with ammonium nitrate (AN). Methyl-nitroguanidine (MeNQ) and ammonium nitrate (AN) also form a eutectic. However, all double salts and eutectics formed with ammonium nitrate (AN) are sensitive to detonation.

Inventors have found that higher analog salts form low melting eutectics with oxidizers other than ammonium nitrate (AN). The higher analog salts of particular interest for explosives include:

triethylenetetramine tetranitrate (TETN),
diethylenetriamine trinitrate (DETN), and
ethylenediamine dinitrate (EDD).

Inventors also found mixtures to be useful.

Interestingly, useful eutectics have been found (by combining one of these compounds or a mixture thereof with nitroguanidine (NQ), methyl-nitroguanidine (MeNQ) or a mixture thereof.

Figure 1:
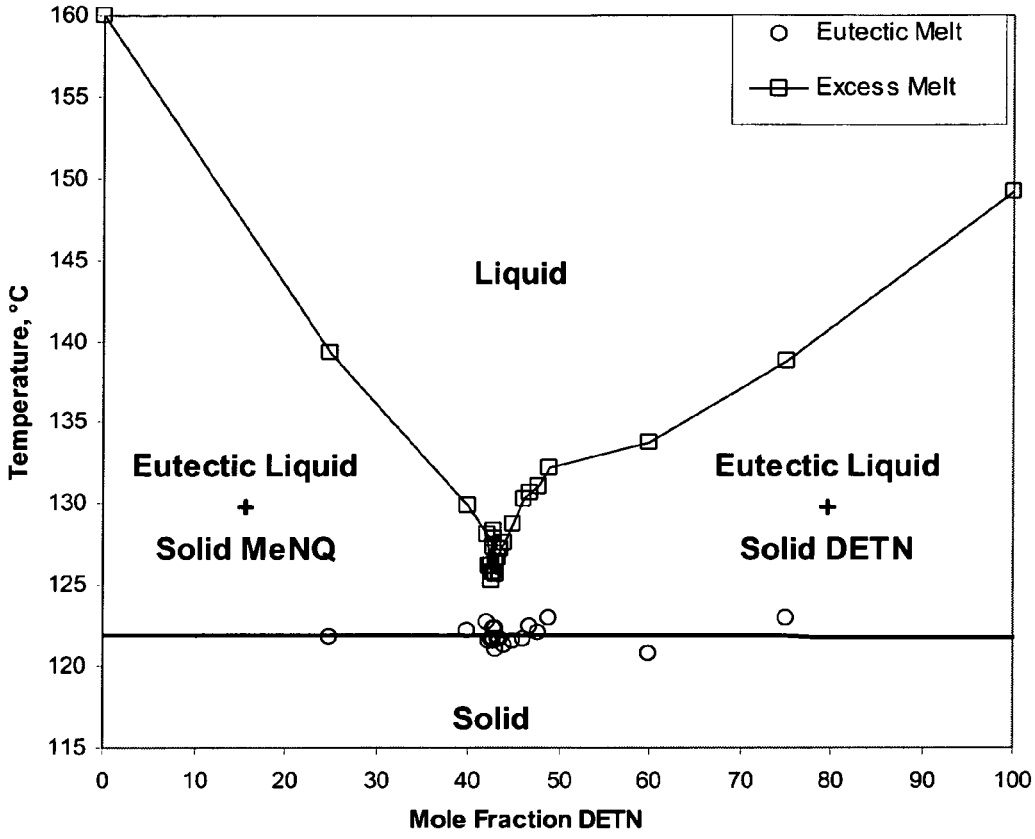
FIG. 1 is a binary phase diagram for the DETN and MeNQ.

Attention is drawn to FIG. 1, a binary phase diagram of diethylenetriamine trinitrate (DETN) and methyl-nitroguanidine (MeNQ). The initial melting point of diethylenetriamine trinitrate (DETN) is nominally 150° C. and of methyl-guanidine (MeNQ) is nominally 160° C. The eutectic composition was identified experimentally by the melting point minimum. This minimum was nominally 122° C. at 43 wt % DETN and 57 wt % MeNQ.

Following this discovery, binary, ternary and quaternary eutectic compositions were formulated between the fuels:

triethylenetetramine tetranitrate (TETN),
diethylenetriamine trinitrate (DETN), and
ethylenediamine dinitrate (EDD);

and the insensitive oxidizers:

nitroguanidine (NQ), and
methyl-nitroguanidine (MeNQ).

A eutectic was discovered for each combination. The phase diagrams for the three component eutectic is three dimensional and the phase diagram for the four component eutectic is four dimensional. Advantageously, the approximately 100° C. melting temperature of the quaternary mixture made it suitable for melt casting the explosive.

BEST MODE

An optimum was discovered for the quaternary eutectic. The quaternary eutectic had a nominal melting point of 101° C. This optimum is the Best Mode contemplated by inventors for use as a desensitized explosive. The optimum composition comprises:

34.9 wt % diethylenetriamine trinitrate (DETN),
33.4 wt % ethylenediamine dinitrate (EDD),
25.4 wt % methyl-nitroguanidine (MeNQ), and
6.3 wt % nitroguanidine (NQ).

This optimum quaternary eutectic is advantageously used in combination with a detonation sensitive explosive.

It is known to those trained in the art that composition variation in batches of the quaternary composition occur do to factors such as weighing and mixing. Compositions adjacent the quaternary eutectic composition are also useful. It is desirable to have a composition with a melting temperature below about 124° C., preferably below about 115° C., more preferably below about 105° C. The most preferred melting temperature is the eutectic melting temperature of 101° C.

CHEETAH thermochemical code is a computation method that predicts the performance of explosives and explosive mixtures based on thermodynamics and reaction kinetics. The prediction method was developed at Lawrence Livermore National Laboratory.

Eutectics were analyzed using the computation method of the CHEETAH thermochemical code. The eutectics were found to have an explosive performance in the range of trinitrotoluene (TNT) and Composition B. Composition B comprises 39.5 wt % trinitrotoluene (TNT), 59.5 wt % cyclotrimethylene trinitramine (RDX) and 1 wt % wax. Wax provides detonation desensitization.

Sensitive nitramines such as cyclotrimethylene trinitramine (RDX) have been added to the insensitive explosive of the invention to adjust shock sensitivity, critical diameter and initiability. The combination of a sensitive explosive with the insensitive composition produces a low melting point solid in the absence of ammonium nitrate (AN) and associated detonation sensitivity. Inclusion of quantities of methyl-nitroguanidine (MeNQ) and nitroguanidine (NQ) produces compositions that are inherently reduced in detonation sensitivity.

The insensitive compositions, including the optimum quaternary eutectic, are preferably used in combination with a sensitive explosive such as:

cyclotrimethylene trinitramine (RDX),
cyclotetramethylene tetranitramine (HMX),
dinitroglycoluril (DINGU),
aminodinitrobenzofuroxane (ADNBF),
diaminodinitrobenzofuroxane (CL-14),
hexanitrohexaazoisowurtzitane (CL-20),
trinitroazetine (TNAZ),
diaminodinitroethylene (FOX-7),
guarnylurea dinitramide (FOX-12),
2,6-diamino-3,5-dinitropyrazine-1-oxide (LLM 105),
nitroguanidine
equvalents thereof and
mixtures thereof.

These sensitive explosives, as well as the insensitive compositions per se are used in the absence of ammonium nitrate (AN), ammonium perchlorate (AP), lithium perchlorate, or equivalent oxidizers.

Explosives of the invention were intended for use in the 155 mm artillery projectile. For this purpose, compositions of the Best Mode insensitive explosive composition in combination with cyclotrimethylene trinitramine (RDX) were formulated and tested for sensitivity according to the Naval Ordnance Laboratory (NOL) Large Scale Gap Test (LSGT). Test results are reported in Example 6 and graphically presented in FIG. 2, a plot of Gap Pressure measured in kilobars (kbar) versus RDX content of the composition tested.

The Naval Ordnance Laboratory (NOL) Large Scale Gap Test (LSGT) is used to determine the sensitivity of an explosive composition to shock pressure. The test apparatus includes a blasting cap and booster charge to provide shock pressure, a variable gap and polymethylmethacrylate (PMMA) gap separation cards for measuring the gap, a steel tube container, and a witness plate to verify detonation. In the testing procedure, the gap is increased until the test material fails to detonate. The NOL LSGT was developed by the Naval Ordnance Lab (NOL) and is also referred to as the card gap test. Expanded Large Scale Gap Test (ELSGT) is similar to NOL LSGT at approximately double the scales.

During the test the gap, i.e the separation of the test sample from the booster charge, is measured by 0.01 inch thick polymethylmethacrylate (PMMA) cards. Each card indicates 1 kilobar of gap pressure. The test is reported as the number of cards or as the kilobars of gap pressure at which the sample fails to detonate. A wider gap at detonation indicates the test material is less shock sensitive. 70 cards is the nominal division between high detonation sensitivity explosives and low detonation sensitivity explosives. The test gives only a relative indication of sensitivity. The numerical value depends on sample size, sample density, void fraction, sample preparation and characteristics of the test apparatus.

Figure 2:
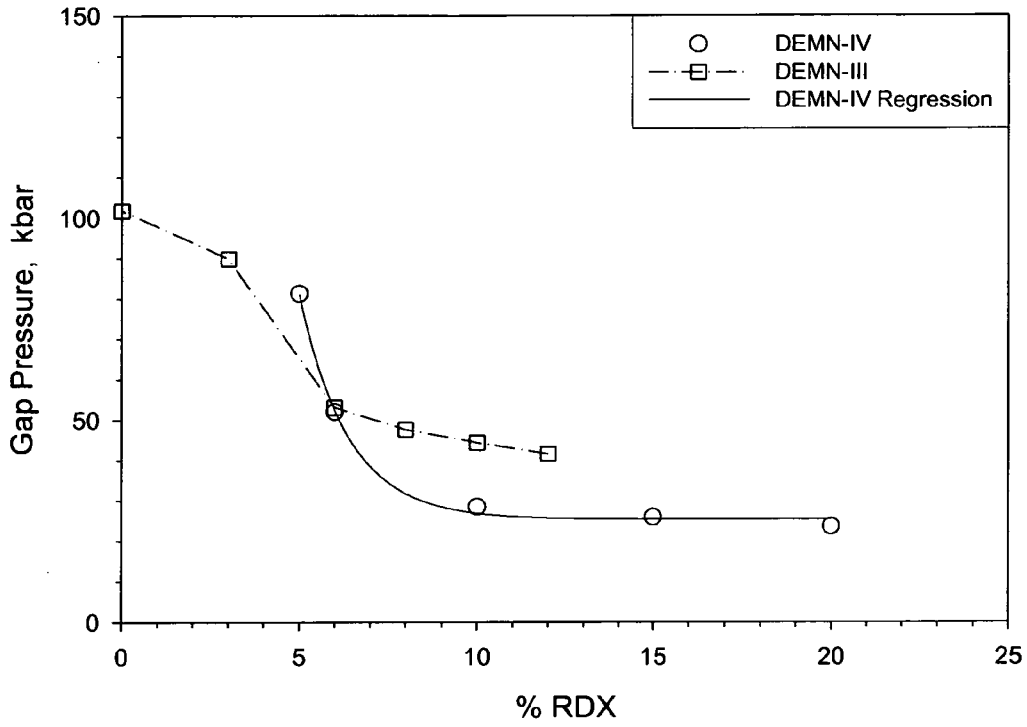
FIG. 2 is a sensitivity diagram for RDX.

A quantity of the Best Mode insensitive explosive was divided into five portions. Cyclotrimethylene trinitramine (RDX) was added to four of the portions. The five portions were tested according to the Large Scale Gap Test. Results are reported in FIG. 2. Each point on FIG. 2 represents a group of 7 NOL LSGT test measurements. The card gap is varied to find the 50% point. The pressure corresponding to the card gap is reported. This pressure is taken from calibration data.

Also shown in FIG. 2 are the detonation sensitivity for two conventional 155 mm artillery shell fills. PBX-9502 is the upper horizontal line and AFX-757 is the lower horizontal line. PBX-9502 is an insensitive high explosive (IHE) comprising 95% triaminotrinitrobenzene (TATB) and 5% polymer binder. AFX-757 is an insensitive high explosive (IHE) comprising 25% cyclotrimethylene trinitramine (RDX), ammonium perchlorate, aluminum powder and rubber binder.

It is desirable to have an explosive composition with an explosive effect measured by the Large Scale Gap Test (LSGT) between 50 and 70 kilobars. It is also desirable to have an explosive composition with Large Scale Gap Test (LSGT) between that of PBX-9502 and AFX-757. The desired explosive would be classified as an Insensitive Munition (IM) as specified in MIL-STD-2105C. Inventors have found an explosive with these characteristics. This explosive comprises an insensitive explosive component and 6 wt % to 9 wt % cyclotrimethylene trinitramine (RDX), a sensitive explosive component. The insensitive explosive composition comprises:

34.9 wt % diethylenetriamine trinitrate (DETN),
33.4 wt % ethylenediamine dinitrate (EDD),
25.4 wt % methyl-nitroguanidine (MeNQ), and
6.3 wt % nitroguanidine (NQ).

Other applications may require an amount of sensitive explosive, e.g. cyclotrimethylene trinitramine (RDX), in an amount of 2 wt % to 75 wt %. For example, 5 wt % to 10 wt % is preferred for this application.

An insensitive explosive is high bulk density nitroguanidine (HBNQ). Nitroguanidine is commercially available in a needle crystalline form having a low specific gravity and in a massive crystalline size having a high specific gravity. Either of these is useful for the invention. However, the use of a particulate, high bulk density nitroguanidine (HBNQ) is preferred for processing safety, particularly in the presence of small amounts of water, and for handling. A preferred composition of sensitive explosives is a mixture of particulate high bulk density nitroguanidine (HBNQ) in an amount of 10 wt % to 60 wt % and cyclotrimethylene trinitramine (RDX) in an amount of 2 wt % to 25 wt %.

The energy release rate and blast pressure of the explosive composition are increased with the inclusion of a metal powder. It is known that the particle size should be 100 mesh or finer, preferably about 2 to about 100 microns. The powder will comprise about 0 wt % to about 35 wt %, preferably 5 wt % to 10 wt % of the composition. The higher end of the range is used in under water explosives. In particularly, powders of aluminum, tantalum, zirconium, titanium, boron and the like may be suspended in the melt cast explosive solid.

The invention was discovered by experimentation. Although inventors do not wish to be bound by any specific theory of the mechanism of the invention, they have considered the scientific basis for it.

Military explosives such as trinitrotoluene (TNT) combine oxidizer and fuel in a single molecule resulting in a short diffusion distance between the moieties that cause in the chemical detonation reaction. This is also the case for explosives in which the oxidizer and fuel are combined to form a crystalline compound.

Ammonium nitrate (AN) has the disadvantage of excess oxidizing capacity for explosives. Ammonium nitrate explosives are sensitive to detonation. Other nitrate salts have been used as explosives, but they have an excess of fuel or some other disadvantage. It would be desirable to find an explosive with an oxidizer/fuel ratio near unity.

It is known to those skilled in the art that ammonium nitrate (AN) is difficult to handle and store. At temperatures below 32.3° C. the stable crystal is orthorhombic bipyramidal. At temperatures between 32.3° C. and 84° C. the stable crystal is orthorhombic. A sample of ammonium nitrate (AN) cycled multiple times through the 32.3° C. (90° F.) crystal transition temperature experiences significantly increased shock sensitivity, thereby increasing the hazard potential of the sample. This physical property is particularly undesirable in military ordnance.

A double salt is a compound comprising two different cations and one anion or one cation and two different anions. A double salt with an oxidizer/fuel ratio of 1.0 provides more explosive potential than a mixture of the ingredients in the same ratio. Double salts have also been made from ammonium nitrate (AN) and diethylenetriamine trinitrate (DETN). These double salts are energetic explosives; however, they are sensitive to detonation.

An addition complex is formed from ammonium nitrate (AN) and methyl-nitroguanidine (MeNQ).

Military explosive formulations are often eutectic mixtures of fuel-rich components such as ethylenediamine dinitrate (EDDN), nitroguanidine (NQ) with oxidizer-rich components such as ammonium nitrate (AN), potassium nitrate (KN), calcium nitrate, ammonium perchlorate and lithium perchlorate.

Inventors postulate that the explosive compositions are double salts of the nitrate salt and the nitroguanidine. Inventors have discovered that explosive double salts are formed with the exclusion of ammonium nitrate (AN).

This invention is shown by way of Example.

EXAMPLE

Example 1

DEMN is the acronym given to compositions comprising:
diethylenetriamine trinitrate (DETN),
ethylenediamine dinitrate (EDD),
methyl-nitroguanidine (MeNQ), and
nitroguanidine (NQ).

DEMN compositions were made and reported in Table 1.

TABLE 1

| | Compositions | | | | | |
|---|---|---|---|---|---|---|
| | DEMN | DEMN III D | DEMN IV A | DEMN IV B | DEMN IV C | DEMN IV D |
| DETN, wt % | 34.9 | 17.5 | 27.9 | 31.4 | 29.7 | 33.2 |
| EDD, wt % | 33.4 | 16.7 | 26.7 | 30.0 | 28.4 | 31.7 |
| MeNQ, wt % | 25.5 | 12.7 | 20.4 | 22.9 | 21.6 | 24.2 |
| NQ, wt % | 6.3 | 41.1 | 5.0 | 5.6 | 5.3 | 5.9 |
| RDX, wt % | 0 | 12 | 20 | 10 | 15 | 5 |

Example 2

The density of compositions of Example 1 were calculated by CHEETAH thermochemical code and measured by gas pycnometry. Results of the calculations and measurements are reported in Table 2.

TABLE 2

Densities of DEMN Compositions

| Composition Name | Calculated by CHEETAH Code ($g/cm^3$) | Measuted By Gas Pycnometry ($g/cm^3$) |
|---|---|---|
| DEMN | 1.56 | 1.53 |
| DEMN III | 1.67 | 1.62 |
| DEMN IV A | 1.60 | 1.57 |
| DEMN IV B | 1.58 | 1.55 |
| DEMN IV C | 1.59 | 1.56 |
| DEMN IV D | 1.57 | 1.54 |

Example 3

Compositions from Example 1 were evaluated in the laboratory for sensitivity. The data are reported in Table 3.

TABLE 3

DEMN Sensitivity Data

| | DEMN | DEMN IV A | RDX |
|---|---|---|---|
| Impact $H_{50\%}$ (1) | 65.9 in. | 52.4 in. | 9.8 in. |
| Friction (1) | 32.4 kg. | 28.4 kg. | 14.4 kg. |
| ESD (1) | 0.25 joules | 0.50 joules | 0.10 joules |
| Eact (2) | 36.33 kcal/mol | 38.2 kcal/mol | 47.1 kcal/mol |
| Z (2) | $6.21 \times 10^{12}$ $sec^{-1}$ | $4.67 \times 10^{14}$ $sec^{-1}$ | $2.02 \times 10^{18}$ $sec^{-1}$ |
| Critical Temperature (1) | 215° C. | 196° C. | 216° C. |

(1) MIL STD 1751
(2) ASTM 698

Example 4

The physical properties of DEMN compositions were calculated and compared to that of trinitrotoluene (TNT) and Composition B. The calculated properties of DEMN compositions falls between those of trinitrotoluene (TNT) and Composition B. Estimates of detonation pressure ($P_{cj}$), velocity ($D_v$) and energy ($\Delta H_{det}$) for DEMN, DEMN III and DEMN IV are reported in Table 4.

TABLE 4

DEMN Performance Calculations

| | Density ($g/cm^3$) | $D_v$ (mm/usec) | $P_{cj}$ (kbar) | $\Delta H_{det}$ (cal/g) |
|---|---|---|---|---|
| TNT | 1.63 | 6.90 | 200 | −1020 |
| Composition B | 1.68 | 7.90 | 289 | −1200 |
| DEMN (34.9/33.4/25.4/6.3) * | 1.56 | 7.88 | 208 | −915 |
| DEMN III D (17.5/16.7/12.7/41.1/12) ** | 1.66 | 8.46 | 259 | −978 |

TABLE 4-continued

DEMN Performance Calculations

| | Density ($g/cm^3$) | $D_v$ (mm/usec) | $P_{cj}$ (kbar) | $\Delta H_{det}$ (cal/g) |
|---|---|---|---|---|
| DEMN IV E (32.8/31.4/23.9/5.9/6) ** | 1.61 | 8.09 | 231 | −1006 |

* DETN wt %/EDD wt %/MeNQ wt %/NQ wt %
** DETN wt %/EDD wt %/MeNQ wt %/NQ wt %/RDX wt %

Small scale sensitivity testing indicates DEMN variations; i.e. combinations of DETN, EDD, MeNQ, and NQ, have a sensitivity suitable for military munitions. The impact, friction, and electrostatic sensitivities of DEMN and DEMN IV are listed in Table 3, along with kinetic and Henkin critical temperature data.

The Henkin bath test is used to determine the thermal stability of explosives by isothermally testing samples in a heated metal bath. A 40 mg sample of explosive is weighed and placed in a No. 8 aluminum blasting cap shell. The cap is then sealed. Testing is done on the sealed test samples at a series of temperatures. The test measures time to explosion. A graph is made from final data showing time vs. temperature to determine the thermal stability of the explosive sample (cook-off time and reaction rate). This thermal analysis combined with other tests such as impact sensitivity are used to determine proper explosive handling techniques.

Example 5

Detonation pressure and velocity of DEMN and DEMN IVA were measured and reported in Table 5.

TABLE 5

DEMN Properties Determined Experimentally

| | DEMN | DEMN IV A | TNT |
|---|---|---|---|
| Gap Pressure | >213 kbar (1) | 31.0 kbar | 42.2 kbar |
| Detonation Velocity | — | 7.08 mm/μ sec | 6.90 mm/μ sec |
| Detonation Pressure | — | 231 kbar | 200 kbar |
| Critical Diameter | >75 mm | <51 mm | 13 mm |

(1) No Go at zero cards

All tests MIL-SPEC 1751A

The shock sensitivity of DEMN IV compositions was measured according to the Naval Ordnance Laboratory (NOL) Large Scale Gap Test (LSGT). Results are reported in Table 6.

TABLE 6

DEMN Card Gap Test Data

| | RDX Content | Density | Gap Pressure |
|---|---|---|---|
| DEMN IV A | 20% | 1.50 $g/cm^3$ | 29 kbar |
| DEMN IV B | 10% | 1.50 $g/cm^3$ | 32 kbar |
| DEMN IV C | 15% | 1.53 $g/cm^3$ | 38 kbar |
| DEMN IV D | 5% | 1.54 $g/cm^3$ | 82 kbar |

FIG. 2 was constructed from this data.

The shock sensitivity of DEMN as a function of RDX content is shown in FIG. 2. The desirable range of RDX that may be incorporated into DEMN is from 6 wt % to 9 wt % for detonation insensitive munitions (IM). This is stated nominally as 5 wt % to 10 wt %.

Example 6

A phase diagram for the diethylenetriamine trinitrate (DETN)/methyl nitroguanidine (MeNQ) binary was constructed from laboratory measurements. Binary compositions were compounded over the range of 0 mol % DETN to 100 mol % DETN. The melting points of the compositions were recorded and FIG. 1 was constructed from the data. The melting point of DETN was measured at 150.59° C. The melting point of MeNQ was measured at 160.77° C. A melting point minimum for the binary was found at approximately 122° C. The binary eutectic composition was 43 mol % DETN/57 mol % MeNQ. Data for the eutectic temperature and composition are shown in FIG. 1.

Example 7

TABLE 7

The following data was calculated by Differential Scanning Calorimeter (DSC) thermal trace and analysis software.

| | Onset of Melting | Melting Point | Energy to Melt |
|---|---|---|---|
| DETN | 150.05° C. | 150.59° C. | 140.2 Joule/gram |
| EDD | 188.43° C. | 188.89° C. | 88.74 Joule/gram |
| MeNQ | 160.10° C. | 160.77° C. | 204.1 Joule/gram |
| DEMN | 100.99° C. | 104.07° C. | 106.2 Joule/gram |

The foregoing discussion discloses and describes embodiments of the invention by way of example. One skilled in the art will recognize from this discussion and from the accompanying drawings and claims, that various changes, modifications and variations can be made therein without departing from the spirit and scope of the invention as defined in the following claims and equivalents thereof.

What is claimed is:

1. A insensitive explosive composition comprising:
diethylenetriamine trinitrate (DETN) and
methyl nitroguanidine (MeNQ),
in a molar ratio of 0.55:1 to 1.35:1; and
in the absence of ammonium nitrate.

2. The insensitive explosive composition of claim 1 additionally characterized in the absence of ammonium perchlorate, lithium perchlorate or any other oxidizer.

3. A melt-castable, eutectic explosive composition comprising a higher analog nitrate salt and a nitroguanidine in a molar ratio of 0.55:1 to 1.35:1, wherein:
a. the nitrate salt is selected from the group consisting of:
triethylenetetramine tetranitrate (TETN),
diethylenetriamine trinitrate (DETN)
ethylenediamine dinitrate (EDD), and
mixtures thereof; and
b. the nitroguanidine is selected from the group consisting of:
methyl-nitroguanidine (MeNQ),
nitroguanidine (NQ), and
mixtures thereof
wherein said explosive composition is free of ammonium nitrate or any other oxidizer and has a melt temperature of less than 124° C.

4. A explosive composition comprising a nitrate salt and a nitroguanidine in a molar ratio of 0.55:1 to 1.35:1, wherein:
a. the nitrate salt is selected from the group consisting of:
diethylenetriamine trinitrate (DETN)
ethylenediamine dinitrate (EDD), and
mixtures thereof; and
b. the nitroguanidine is selected from the group consisting of:
methyl-nitroguanidine (MeNQ),
nitroguanidine (NQ), and
mixtures thereof
wherein said explosive composition is free of ammonium nitrate.

5. The explosive composition of claim 4, wherein the nitrate salt is a mixture of diethylenetriamine trinitrate (DETN) and ethylenediamine dinitrate (EDD) and the nitroguanidine is methyl-nitroguanidine (MeNQ).

6. The explosive composition of claim 4, wherein the nitrate salt is diethylenetriamine trinitrate (DETN) and the nitroguanidine is a mixture of methyl-nitroguanidine (MeNQ) and nitroguanidine (NQ).

7. A explosive composition comprising a nitrate salt and a nitroguanidine in a molar ratio of 0.55:1 to 1.35:1, wherein:
a. the nitrate salt is a mixture of:
diethylenetriamine trinitrate (DETN) and
ethylenediamine dinitrate (EDD), and
b. the nitroguanidine is a mixture of:
methyl-nitroguanidine (MeNQ) and
nitroguanidine (NQ)
wherein said explosive composition is free of ammonium nitrate.

8. The explosive composition of claim 7, wherein the nitrate salt and nitroguanide are selected to produce an explosive composition melting below 124° C.

9. The explosive composition of claim 7, wherein the nitrate salt and nitroguanidine are selected to produce an explosive composition melting below 115° C.

10. The explosive composition of claim 7, wherein the nitrate salt and nitroguanidine are selected to produce an explosive composition melting below 105° C.

11. An explosive comprising:
a. an insensitive explosive composition comprising a nitrate salt and a nitroguanidine in a molar ratio of 0.55:1 to 1.35:1, wherein:
i. the nitrate salt is a mixture of:
diethylenetriamine trinitrate (DETN) and
ethylenediamine dinitrate (EDD), and
ii. the nitroguanidine is a mixture of:
methyl-nitroguanidine (MeNQ) and
nitroguanidine (NQ); and
b. a sensitive explosive
wherein said insensitive explosive composition is free of ammonium nitrate.

12. The explosive of claim 11, wherein the sensitive explosive is selected from the group consisting of:
cyclotrimethylene trinitramine (RDX),
cyclotetramethylene tetranitramine (HMX),
dinitroglycoluril (DINGU),
aminodinitrobenzofuroxane (ADNBF),
diaminodinitrobenzofuroxane (CL-14),
hexanitrohexaazoisowurtzitane (CL-20),
trinitroazetine (TNAZ),
diaminodinitroethylene (FOX-7),
guarnylurea dinitramide (FOX-12),
2,6-diamino-3,5-dinitropyrazine-1-oxide (LLM 105),
nitroguanidine (NQ) and
mixtures thereof.

13. The explosive of claim 11, wherein the sensitive explosive is cyclotrimethylene trinitramine (RDX) in an amount of 2 wt % to 75 wt %.

14. The explosive of claim 11, wherein the sensitive explosive is particulate high bulk density nitroguanidine (HBNQ).

15. The explosive of claim 11, wherein the sensitive explosive is particulate high bulk density nitroguanidine (HBNQ) and additionally comprising a powdered metal.

16. The explosive of claim 11, wherein the sensitive explosive is a mixture of particulate high bulk density nitroguanidine (HBNQ) in an amount of 10 wt % to 60 wt % and cyclotrimethylene trinitramine (RDX) in an amount of 2 wt % to 25 wt %.

17. The explosive of claim 11, wherein the sensitive explosive is a mixture of particulate high bulk density nitroguanidine (HBNQ) in an amount of 10 wt % to 60 wt % and cyclotrimethylene trinitramine (RDX) in an amount of 2 wt % to 25 wt % and additionally comprising a powdered metal.

18. The explosive of claim 11, additionally comprising a powdered metal.

19. The explosive of claim 11, additionally comprising a powdered metal selected from the group consisting of aluminum (Al), zirconium (Zr), titanium (Ti), tantalum (Ta), magnesium (Mg) and mixtures thereof.

20. The explosive composition of claim 1 wherein said explosive composition is a melt castable, eutectic composition with a melting point of less than 125° C.

* * * * *